US006491241B1

(12) United States Patent
Sun

(10) Patent No.: US 6,491,241 B1
(45) Date of Patent: Dec. 10, 2002

(54) DEVICE FOR THE DISPERSAL AND CHARGING OF FLUIDIZED POWDER

(75) Inventor: Hoi Cheong Sun, Dayton, NJ (US)

(73) Assignee: Delsys Pharmaceutical Corporation, Monmouth Junction, NJ (US)

( * ) Notice: Subject to any disclaimer, the term of this patent is extended or adjusted under 35 U.S.C. 154(b) by 0 days.

(21) Appl. No.: 09/417,820

(22) Filed: Oct. 14, 1999

Related U.S. Application Data

(60) Provisional application No. 60/104,207, filed on Oct. 14, 1998.

(51) Int. Cl.[7] ..... B02C 19/06
(52) U.S. Cl. ..... 241/39; 241/80; 241/97
(58) Field of Search ..... 247/5, 39, 40, 247/80, 97

(56) References Cited

U.S. PATENT DOCUMENTS 3,229,918 A 1/1966 Trost
3,462,086 A * 8/1969 Bertrand et al. ..... 241/39
3,741,485 A 6/1973 Gage et al.
3,856,215 A 12/1974 Van Vliet
4,189,102 A * 2/1980 Andrews ..... 241/5
4,198,004 A 4/1980 Albus et al.
4,248,387 A * 2/1981 Andrews ..... 241/5
4,519,822 A 5/1985 Hatano et al.
4,600,417 A 7/1986 Sasaki et al.
4,729,663 A 3/1988 Karg
4,731,228 A 3/1988 Dewitz et al.
4,743,363 A 5/1988 Darrow
4,789,476 A 12/1988 Schulz
5,236,479 A 8/1993 Billingsley
5,628,464 A 5/1997 Smith et al.
5,788,728 A 8/1998 Solis et al.
6,170,768 B1 * 1/2001 Harmon et al. ..... 241/5

* cited by examiner

*Primary Examiner*—Mark Rosenbaum
(74) *Attorney, Agent, or Firm*—Dechert

(57) ABSTRACT

Provided is, among other things, and together with associated methods, a powder feed comprising: a venturi comprising an external gas inlet, a gas outlet through which gas flows at a rate amplified over a gas flow rate into the external gas inlet, and an internal gas inlet; and a cyclone with an intake port connected to the venturi gas outlet, a recycle outlet port, and a product port, wherein a gas flow rate $F_S$ into the venturi external gas inlet results in an enhanced flow rate into the cyclone intake port.

14 Claims, 13 Drawing Sheets

DEVICE FOR THE DISPERSAL AND CHARGING OF FLUIDIZED POWDER

This application claims the benefit of U.S. Provisional Application No. 60/104,207, filed Oct. 14, 1998.

The present invention relates to a dry powder feed and charging devices that can, for example, be used in dry powder deposition apparatuses.

The applicants have previously described apparatuses and techniques for using electromagnetic forces to make controlled depositions of materials. Such depositions make it possible to deposit controlled amounts of, for example, a pharmaceutical onto spatially resolved areas of a substrate. Described herein are further improvements to the methods and techniques for controlled deposition. In particular, the invention provides cyclones, powder feeds and deposition stations that can improve powder charging, powder consistency, powder sizing, reproducibility of deposition, and other aspects of handling powders.

The present invention provides improvements in handling fluidized powder dispersed in a carrier gas. Within a device of the invention, powders of particle aggregates and particle grains can be reduced in size via collisions with particulate matter carried by a gas or by collisions with a surface of the device. Particles can be charged by, for example, triboelectric, inductive or corona charging methods within the inventive system. The invention further provides for improved efficiency in the dispersion and charging of powders in a carrier gas by, for example, amplifying the internal flow rate of the gas/powder mixture while further providing a controllable, typically slower, rate of powder output. The powder output can be made up of particles of a selected charge polarity. Another aspect of the invention relates to the optical monitoring of the amount of fluidized powder flux.

SUMMARY OF THE INVENTION

The invention provides, together with associated methods, a powder feed comprising: a venturi comprising an external gas inlet, a gas outlet through which gas flows at a rate amplified over a gas flow rate into the external gas inlet, and an internal gas inlet; and a cyclone with an intake port connected to the venturi gas outlet, a recycle outlet port, and a product port, wherein a gas flow rate $F_S$ into the venturi external gas inlet results in an enhanced flow rate into the cyclone intake port.

The invention further provides, together with associated methods, a cyclone comprising: a milling chamber adapted to cause, under the force provided by a flow of gas, particles therein to collide with the chamber or other particles to mill the particles; a product output port located on the milling chambe/r to preferentially favor the output of milled particles, wherein the product output port is electronically isolated from the milling chamber; an electrical power source; and an electrical conduit that can be opened or closed for conveying from the power source a potential to the product output port.

The invention also provides, together with associated methods, a powder feed cell comprising: a chamber with an outlet port; a gas input conduit; and a venturi located within the chamber and connected to the gas input conduit, wherein the venturi has inlet port that draws fluidized powder from within the chamber and an outlet port that expels fluidized powder within the chamber, and wherein when gas flows into the venturi from the gas input conduit the venturi effect draws gas through the inlet port and proportionately increases gas flow at the outlet port, wherein the gas flow from the venturi outlet port is adapted to suspend at least a portion of a powder located within the chamber.

The invention also provides, together with associated methods, a powder handling device comprising: a cyclone comprising one or more surfaces along which fluidized powder flows during operation of the cyclone; and a source conduit of fluidized powder connected to the cyclone comprising a venturi effective to create turbulence in the fluidized powder.

The invention also provides, together with associated methods, a powder coating device comprising: a conduit for conveying charged powder particles suspended in a gas flow; and a depression, wherein powder particles suspended in the gas flow deposit on the internal surface of the depression.

The invention further provides, together with associated methods, a powder flux detecting device comprising: a conduit for carrying gas-fluidized powder, the conduit with an upstream end and a downstream end towards which the fluidized powder flows, in which conduit is incorporated a venturi is adapted to increase gas flow or turbulence in the gas flow; at least one laser directing a laser beam across the conduit, the laser comprising a window separating it from the conduit; and at least one detector adapted to intercept the laser beam or light scattered from the laser beam, the detector comprising a second window separating it from the conduit, wherein the laser and detector are positioned downstream of the venturi and in sufficient proximity so that increased gas flow or increased turbulence reduces powder coating of the first and second windows from that which would occur in the absence of a proximate venturi.

DETAILED DESCRIPTION OF THE INVENTION

Figure 1A:
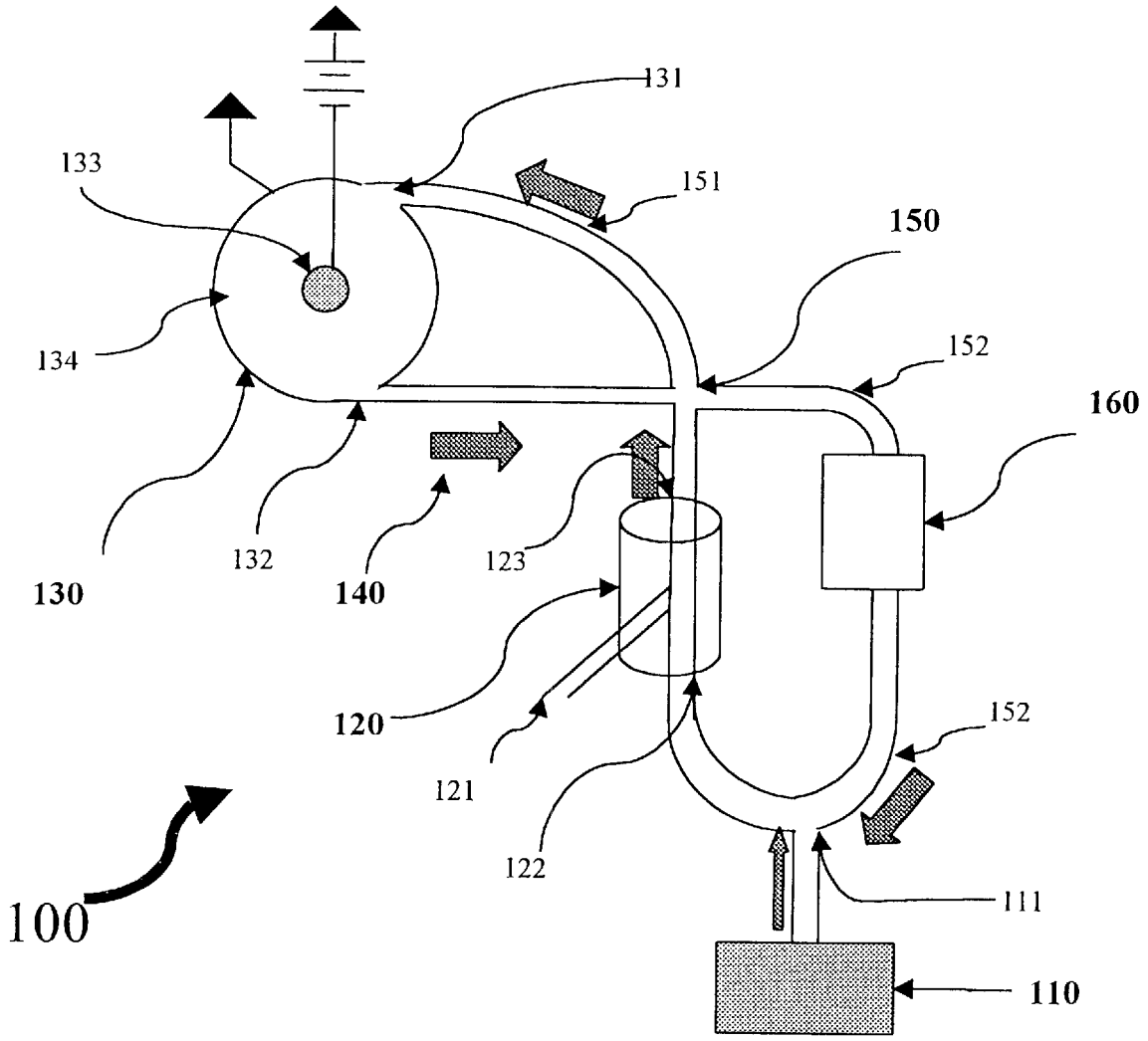
FIGS. 1A and 1B show embodiments of the invention comprising closed loop configuration of a cyclone or jet mill classifying chamber, a venturi, a powder reservoir and a second cyclone.

FIG. 1 illustrates a preferred embodiment of the present invention that provides a loop configuration of powder flow conduits which is a cyclone resonator 100 comprising a venturi 120 and a first cyclone 130, which can be a jet mill. The loop configuration is optional. The cyclone resonator configuration allows for the decoupling of the aerodynamic and electrostatic components in powder fluidization. For example, powder flow for charging or milling is typically faster than is convenient or accurately used in downstream processes such a electrostatic coating. Block arrows 140 show the operating direction of gas/powder flow through the cyclone resonator 100. The venturi 120 includes an external gas inlet 121, an internal gas inlet 122, and an internal gas outlet 123.

The venturi 120 amplifies the rate gas flow across internal gas inlet 122 and internal gas outlet 123 by an amount of gain. A venturi with a gain of 40:1 or less can be obtained commercially, for example from Vaccon Company, Inc. (Medfield, Mass.). Carrier gas is pumped into a venturi at external gas inlet 121 to cause amplified gas flow at internal gas outlet 123. A mixture of powder suspended in a carrier gas can be pumped through a venturi 120 with an amplification of flow rate characterized by the venturi gain. For instance, if a carrier gas enters a venturi with a gain of G at a rate $F_S$, powder/carrier gas enters the venturi at the internal gas inlet 122 at a rate $(G-1)F_s$ and exits the venturi at the internal gas outlet 123 at a rate $GF_s$. Thus, an amplification of the powder/gas mixture of $F_s$ is achieved. The rate of powder/gas flow through the venturi can be controlled by adjusting the carrier gas flow rate at the external gas inlet 121.

First cyclone 130 includes three ports: an intake port 131 where fluidized powder can enter the first cyclone 130, a recycle outlet port 132 and a product port 133. Powder/gas intake port 131 is connected to the venturi internal gas outlet 123 by first conduit 151. Recycle outlet port 132 is connected to venturi internal gas inlet port 122 either directly or via second cyclone 160 by second conduit 152. The disposition of the intake port 131, the recycle outlet port 132 and product port 133 with respect to each other is such that the first cyclone 130 is capable of functioning as a classifying chamber that affects the preferential separation of heavier particulates via centrifugal force along the inside wall of the first cyclone 130 from the intake port 131 to the outlet port 132, while lighter particulates can be preferentially directed out of the first cyclone 130 through the product port 133. The intake port 131 and outlet port 132 can be in the same plane and tangentially disposed with respect to the circular internal wall 134 of the first cyclone 130. The product port 133 can be oriented substantially perpendicular to the plane of the intake port 131 and outlet port 132. The dimensions of the cyclone, intake port 131, outlet port 132 and discharge port 133 can be chosen to optimize the powder delivery process desired.

In one embodiment, most powder charging in the modified cyclone resonator 100 apparatus of the disclosure occurs in the venturi 120. Powder charging is a function of the properties of the powder and, to a lesser extent, the material the powder contacts inside Venturi. For example, a Teflon (polytetrafluoroethyene typically) coating with the venturi 120 promotes negative powder charging; Nylon (polyamide) coating typically promotes positive charging.

The cyclone resonator 100 can further include a powder dispensing apparatus 110 that can be selected from a number of types, but can preferably (1) be sealed to the system (no leaks), (2) operate at equilibrium with the system (no powder fed) or at a set, slightly higher pressure (e.g. 1 psi) to feed powder into the system and (3) have a powder reservoir. A flow controller can be used to set the pressure in the powder reservoir and the pressure can be correlated to the flow rate of gas into the venturi which controls the rate of gas/powder flow in the system loop. The entrance 111 of the powder dispenser 110 can be positioned to allow the flow of powder into second conduit 152 or first conduit 151. The illustrated positioning where powder is fed into second conduit 152 prior to powder flow reaching venturi 120 is one preferred embodiment.

The configuration of the venturi to form a closed loop with the first cyclone 130 and the venturi 120 is one aspect of this invention. This situation of the venturi in communication with the first cyclone 130 and the powder reservoir 110 via a loop alleviates a backpressure problem, whereby vacuum created by action of the venturi increases the pressure on the exhaust side above the pressure on the input side (e.g. 1 atm) until the pressure difference across the venturi overcomes the amplified pumping action and flow stops. In the exemplified loop configuration, increased flow rate can be attained through the venturi while the output of the cyclone is substantially the same as the flow rate of gas into the venturi. Thus, if gas is flowing through the second conduit 152 at 40 L/m and a gas flow of 20 L/m is introduced to the external gas inlet of the venturi, the gas/powder inside the first cyclone 130 loop will flow at 60 L/m while the output of fluidized powder/gas from the first cyclone 130 can be at 20 L/m. The loop configuration of the cyclone resonator 100 raises the rate of powder flow inside the jet mill (increasing both the efficiency of both powder dispersion and powder charging) while allowing for a slower rate of fluidized powder output from the jet mill. A slower powder flow rate is better for subsequent processes such as deposition. The rate of fluidized powder output through product port 133 is substantially the same as the rate of gas used to drive the venturi through the external gas inlet 121, offering control of powder output from the cyclone resonator 100.

Figure 1B:
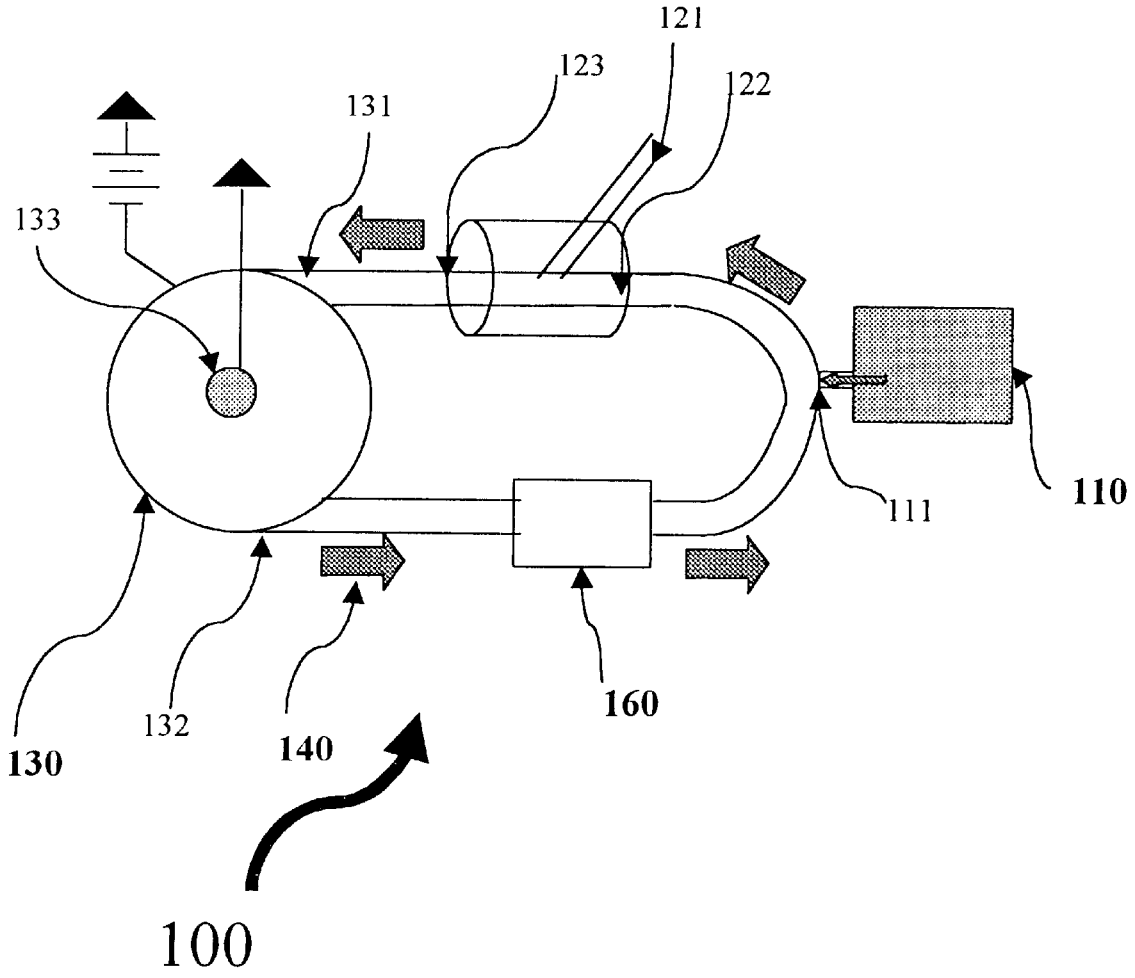

The closed loop configuration of the cyclone resonator 100 can also include a cross-over region 150, as shown for instance in FIG. 1A, where particles carried from the venturi internal gas outlet 123 moving towards the intake port 131 can collide with other particles leaving from the cyclone recycle outlet port 132. Collisions at and near the cross-over region 150 under the force provided by the flow of gas through the loop act to enhance powder dispersion. FIG. 1B illustrates a closed loop configuration of the inventive system without a cross-over section.

The invention further provides for the electrical isolation of the product port 133 of the first cyclone 130 from the internal wall 134 of the cyclone, allowing one to bias (or reverse bias) the product port 133 with respect to the internal wall 134, resulting in promoting (or blocking) the exit of charged, fluidized particles from the cyclone chamber. Applying a bias between the product port 133 of the first cyclone 130 and the internal walls 134 can be used to attract charged particles to the outlet. When an appropriate bias is applied across product port 133 and internal portions of the first cyclone 130, for example, 600 V, about 80% or more of particles that exit can be charged with like polarity. When an exit-promoting polarity is applied, the deposition of charged particles on the walls of the product port 133 is minimized by gas flow. One example of an exit-promoting bias for positively-charged particles is illustrated in FIG. 1A; an example of an exit-inhibiting bias is illustrated in FIG. 1B.

At higher operating pressures, the inventive system, as embodied for instance in the cyclone resonator 100, can act as a jet mill to break up individual particles as well as aggregates of particles. Collisions with other particles or with internal surfaces of a device embodiment of the instant invention disperse the powder under force provided by a flow of gas. A greater centrifugal force acts on larger particles as they move through the cyclone resonator 100, which increases the abundance of smaller particles in the central region of the classifying chamber where the product port 133 can be situated. The selection of smaller particles through the product port 133 can be enhanced by applying an appropriate electrical bias between the product port 133 and the internal walls 134 of the first cyclone 130 using an electrical power source and electrical conduit that can be opened or closed for conveying from the power source a potential to the product output port 133.

The cyclone resonator 100 can include the addition of a second cyclone 160. In contrast to the first cyclone 130 that acts as a classifying chamber, the cyclone device 160 can be adapted to increase the contact of the powder with the surface of the second cyclone device 160, thereby affording more opportunity for triboelectric charging of the powder via collisions with the walls of the second cyclone device 160.

A further aspect of the invention is a powder charge induction component comprising for example, (a) a charge-induction conduit with a conductor, through which conduit the powder flows, and a power source that applies a potential to the conductor effective to induce charge in the powder, (b) a tribocharging surface or tribocharging surfaces situates to collide with the powder or (c) a corona-charging component (such as one of the numerous corona-charging guns used in powder-based spray painting. For example, in cyclone 200 (FIG. 2), there is a diffractor 220, electronically biased or isolated to enhance the charging of powder that collides with the diffractor. The angle of the diffractor with respect to the channel conducting the powder entering the cyclone powder circulation zone can be adjusted to enhance charging. A jet confinement liner 230 made of a material that enhances charging can also be used. For example, the confinement layer 230 can be made of a tribocharging material or, for induction charging, an electronically biased conductor such as stainless steel.

Figure 2:
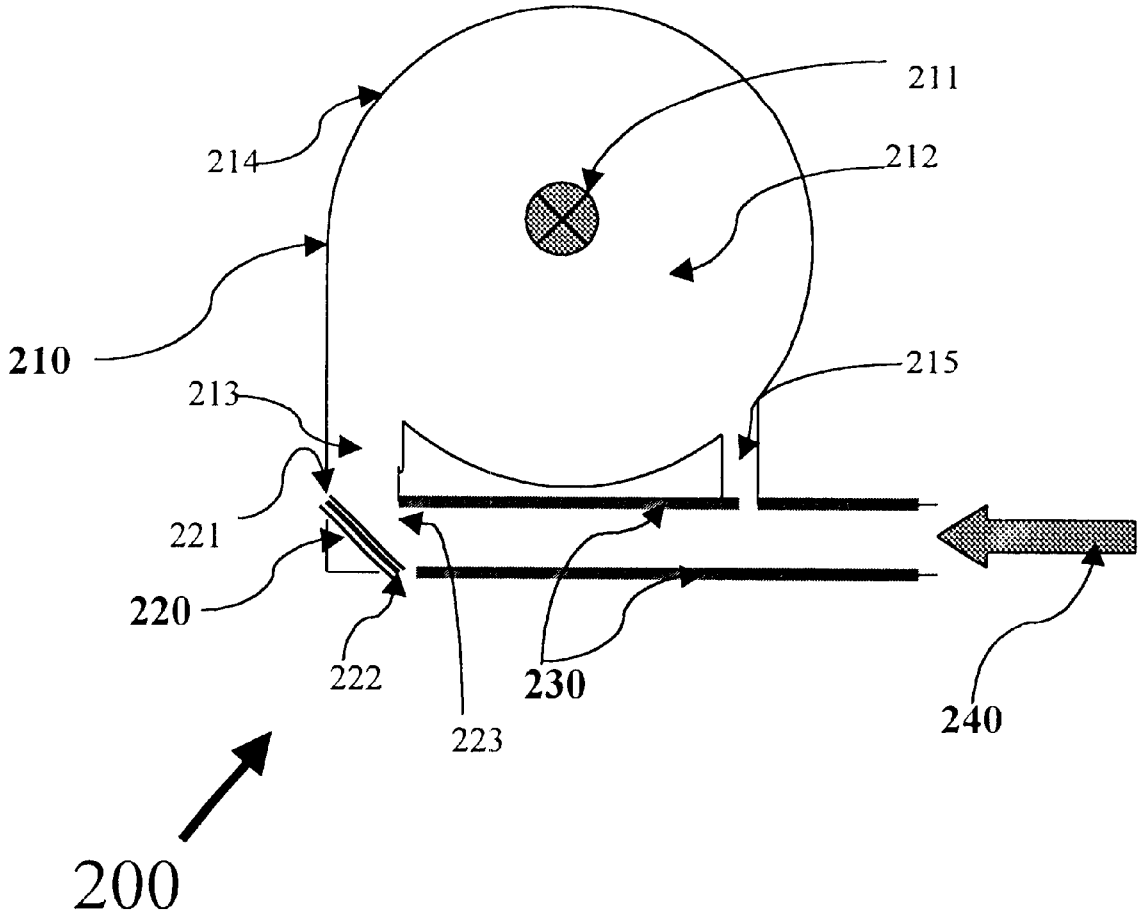
FIG. 2 illustrates improvements to a jet mill comprising a classifying chamber that include a diffractor and a jet confinement liner.

The invention further pertains to the charging of powder with a first polarity by a powder charge induction component, such as the diffractor 220, and the application of a potential to the product output port 211 to electrostatically discourage powder of the first polarity from exiting the jet mill or cyclone. Electronic isolation of the diffractor 220 is shown in FIG. 2 at points 221 and 222. The diffractor 220 can be biased with respect to the walls 214 of the cyclone 200 to enhance the efficiency of the powder charging by inductive charging. In contrast, bias applied between the cyclone product outlet port 211 and the walls 214 can enhance separation of particles. The diffractor 220 surface is usually the cleanest surface in the system during operation and acts as the principle charging surface in the apparatus here illustrated. The diffractor can be made of a material selected to best improve the charging of the particles, such as stainless steel or anodized aluminum.

The jet confinement liner 230 can be of variable thickness and can enhance the charging of the gas. In one embodiment, the jet confinement liner 230 constricts the gas/powder flow 240, increasing the gas/powder flow velocity. Material for the jet confinement liner 230 can be selected to enhance charging (also confining the location of charging to the region near the diffractor).

Figure 3A:
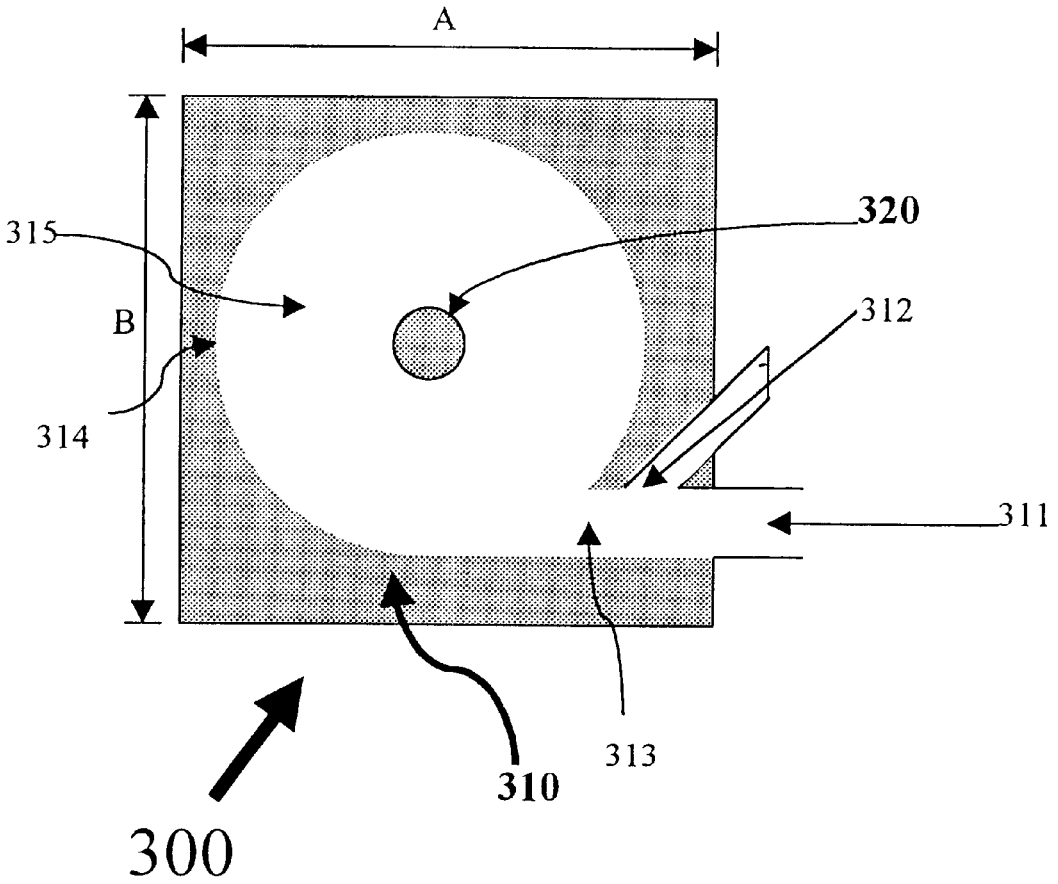
FIG. 3 shows a top view (FIG. 3A) and cross section (FIG. 3B) of a device of the instant invention.
Figure 3B:
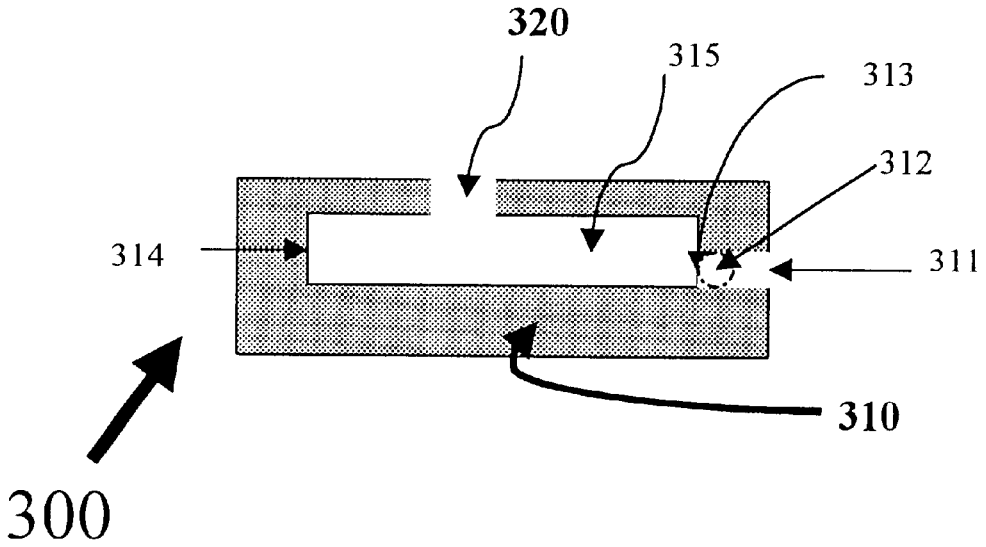

FIG. 3 shows a further embodiment of the invention, a cyclone device 300 for providing powder for electrostatic deposition, With the cyclone device 300, for example, small amounts of charged powder can be produced. The illustrated embodiment of FIG. 3 can be constructed and operated at a scale that allows effective charging of a few milligrams of powder, such as 10 or 5 mg or less. A high turbulence region of the cyclone device 300 aids in the deagglomeration of powder. The cyclone device 300 can be constructed with dimensions A and B of 1 inch or less, with a height dimension of ¼ inch, or less.

A cyclone region 315 can act as a classifying chamber wherein powder can be dispersed or milled using an applied gas flow. A biased conductive housing/wall 310 to the cyclone region can inductively charge powder circulating in contact with the region upon application of a high voltage bias to the wall. Powder pulled in by gas flowing through the jet intake 311 can be broken down as a result of collisions, particularly in a turbulence zone 313 near a powder feed 312 and the gas jet intake 311. Preferably, smaller particles can escape through a powder outlet 320, preferably oriented substantially orthogonal to the plane of the cyclone. More preferably, larger powder particles can circulate around the cyclone region 315 where powder can be broken down further and be charged inductively. Preferably, powders leave the device highly charged and dispersed.

The turbulence zone 313 is created by adapting the gas jet intake 311 to produce a venturi effect (and thus comprise a venturi). The positioning of the powder feed 312 as illustrated in FIG. 3 takes advantage of the venturi effect to create a vacuum to draw in powder from powder feed 312, but such powder feeding is optional, as the turbulence occurs with powder already suspended in to the material fed into the gas jet intake 311 in devices where no aspirator inlet such as the illustrated powder feed 312 are used. Though the turbulence zone 313 is illustrated as immediately adjacent to the cyclone region 315, this is but a preferred aspect. Preferably, the turbulence zone is positioned close enough to the cyclone region so that turbulence remains when gas flow reaches the cyclone region. For example, the turbulence zone can be within 60 cm or 30 cm of the cyclone region, or closer.

Figure 4A:
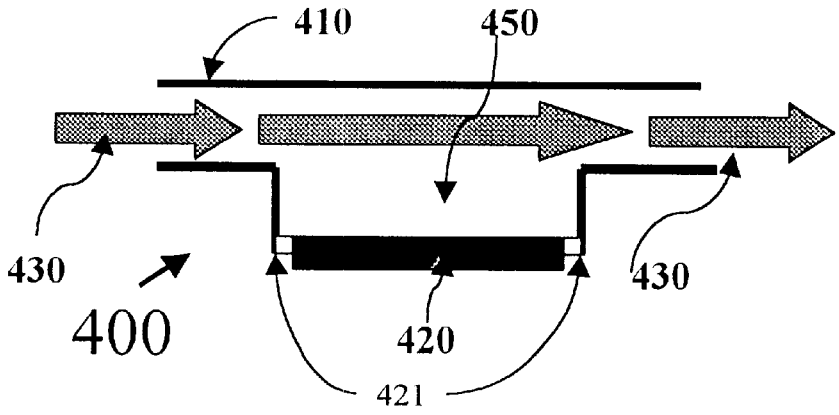
FIG. 4 shows a deposition device for the deposition of powders in cavities.
Figure 4B:
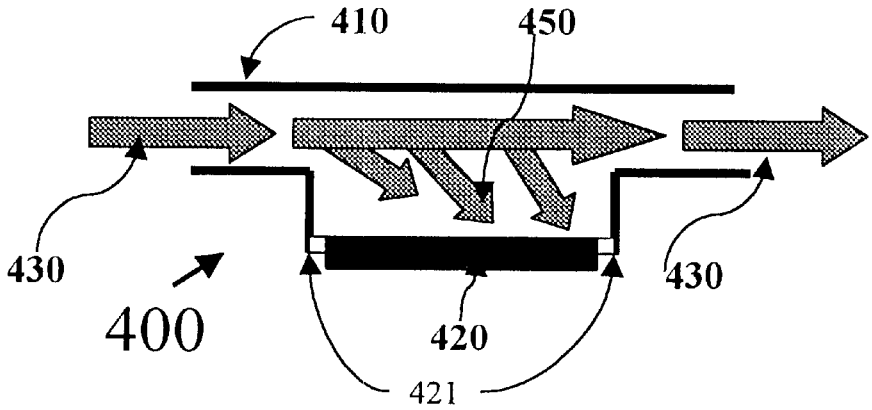
Figure 4C:
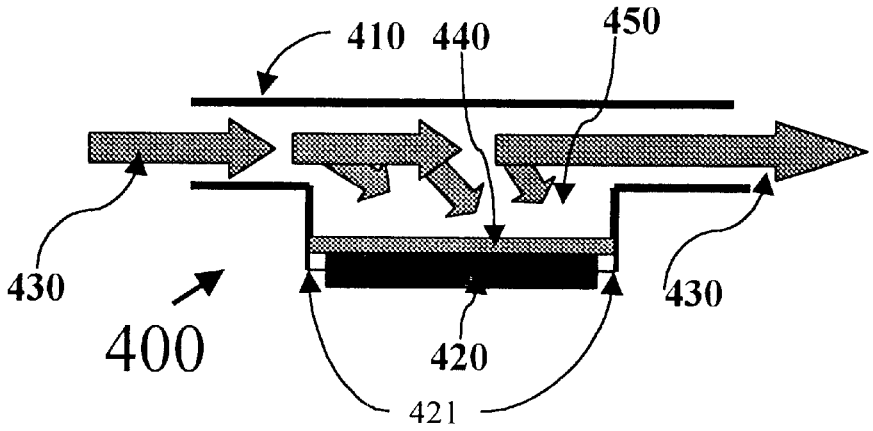
Figure 4D:
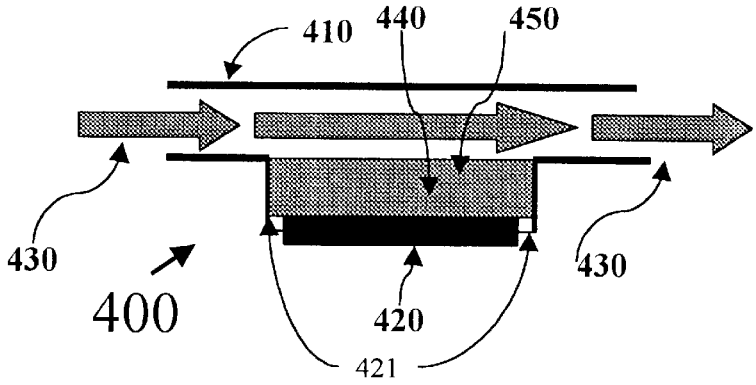

Another embodiment of the invention relates to the electrostatic deposition of powders in cavities. A conduit 410 for conveying charged powder particles suspended in a gas/powder flow 430 and a depression 450. Preferably, the depression 450 comprises on or adjacent to a surface thereof a conductor 420, wherein the depression 450 is adapted, when a potential is applied to the conductor 420, to attract a substantially uniform coating of the charged powder particles 440. The conductor 420 can directly contact the conduit 410 as illustrated, or be covered with a dielectric which is adapted to allow a sufficient attractive field generated from the conductor 420. FIGS. 4A to 4D show steps involved in deposition of charged particles 440 into one or more depressions 450. Preferably, deposition can occur until the deposition fills the cavity as shown in FIG. 4D.

Without being limited to theory, it is believed that the repulsion of particles (i.e. the space charge) in the gas/powder flow 430 flowing through the conduit 410 causes the mixture to expand outward from the center to fill the depression 450 and pushes down on charged powder particles 440 deposited on the outermost surface of the cavity. The space charge effect is believed to overcome aerodynamic gas currents that may resist powder deposition near the edges of the cavity. The image charge produced when charged particles near the conductor also provides an attractive force for deposition on top of the conductor, and biasing the conductor enhances this effect. Two forces are believed to contribute to the uniform packing density of the powder: the image charge acts to preserve charge neutrality and the space charge acts to induce uniform packing.

In one embodiment of the invention, a biased conductor 420 on the outermost cavity surface can increase the rate of deposition. The electrostatic forces (space charge and image charge) can be stronger than the bias applied to the underlying conductor. Preferably, the electrostatic deposition of powder in the cavity occurs with better uniformity of packing density than if gravity was responsible for powder settling into the cavity. In a further preferred embodiment of the invention, the depressions 450 are situated to resist gravity-driven particle deposition in cavities. Preferably, depressions 450 are aligned so that gravity does not act to settle the powder (for example, upside down or sideways cavities).

In some preferred embodiments, the size of the charge particles can affect the rate of deposition: larger powders can pack with a lower density while finer powders (which have higher charge/mass ratios) can deposit faster.

Figure 4E:
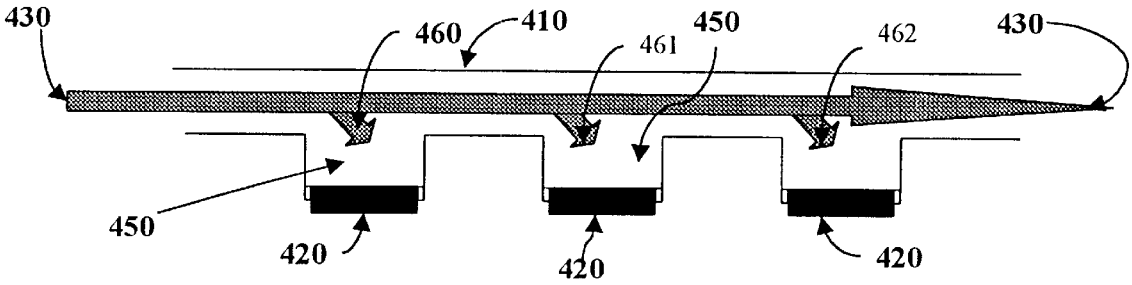

The fluidized powder/gas flow, for example out of the cyclone resonator 100, can flow through a conduit 410 with depressions 450 and eventually to an exhaust. In another embodiment, the cavities can be introduced along the conduits of the cyclone resonator 100, and the outlet port 133 of the jet mill portion of a device with the cyclone resonator 100 can be reverse biased to keep the powder flowing through the cyclone loop until sufficient deposition levels are attained in the depressions 450. Multiple depressions 450 can be arrayed along a single channel, as shown in FIG. 4E, and the ratio of rates of deposition in each depression 450 (e.g. first rate 460, second rate 461, . . . $n^{th}$ rate 462) is typically constant (i.e. ($n^{th}$ rate 462)/(first rate 460) equals a constant). The reasons for the consistent relationships between deposition rates 460, 461, 462 is not yet well understood.

Another preferred embodiment of the present invention includes a powder feed cell 500, such as the device diagramed in FIG. 5, that delivers substantially dispersed, fluidized, charged particles 513 through an outlet port 515. The powder feed cell 500 comprises a chamber 510 with an outlet port 515, a gas input conduit 512, a venturi 520 located within the chamber. The venturi 520 is connected to gas input conduit 512, and has a venturi inlet port 521 (aspirator inlet) and a venturi outlet port 522 located within the chamber 510. The venturi inlet port 521 draws fluidized powder from within the chamber and fluidized powder can be expelled from the chamber through a venturi venturi outlet port 522. Preferably, as gas flows into the venturi from the gas input conduit 521, gas is drawn from the venturi inlet port 521 and the venturi 520 proportionately increases gas flow 523 at the venturi outlet port 522. The gas flow 522 from the venturi outlet port and the shape of the chamber 510 are positioned and adapted to suspend at least a portion of the powder 530 located within the chamber.

Preferably, the venturi 520 is situated within in the chamber 510 with rounded corners 511 to fluidize powder inside the chamber. Preferably, the container 510 does not have sharp corners, so as to avoid aerodynamic "dead regions" where powder can stagnate. Gas flows within prospective chambers can be mathematically modelled, as is known in the art, to reduce such dead zones. In one embodiment, which is a vertical configuration (FIG. 5A), one venturi is combined with vibration provided by vibrator 540 to promote exposure of powder to the amplified gas flow from the venturi outlet port 522 of the venturi. Preferably, the outlet 515 can be electrostatically isolated from the walls of the cell 514. Preferably, the rate of internal powder flow 523 can be higher than the rate of powder leaving the container 513 because of the gain of the venturi. Increased rate of powder circulation can enhance the efficiency of powder dispersion in the chamber while the slower rate of gas/powder exiting the chamber can be advantageous for powder deposition. In another embodiment of the invention, two or more venturi 520 oriented in different directions (FIG. 5B) can be used in a cell 550. The illustrated cell 550 without sharp corners and without vibration of the cell and operates without a vertical configuration. The number of venturi and their orientation in a cell 550 can be determined by a skilled artisan.

Powder obtained from a vendor or production process typically contains a distribution of powder sizes. Particles larger than the mean size can cause dosing problems when conducting depositions, a problem that can be hard to solve. Particles that are substantially smaller than the mean size can charge easier than the larger particles. Typical powder sizes are 10–30 $\mu$m in diameter, so a mesh roughly twice this size (40–80 $\mu$m) is typically used to sieve the powder. The sieving process using conventional means of propelling a powder in a gas via a jet typically results in clogging of the mesh with larger particles.

The invention also provides a powder selection device 600. A mesh 620 is used to select out smaller particles 630 from a powder flowing out of a venturi outlet 613. Preferably, the screen or mesh 620 is situated at an angle between 0–90 degrees 660 between the center-line of the powder output and the cross sectional line of the screen (as calculated depending on the rate of flow and gain of the venturi). More preferably, small particles are filtered through the screen/mesh 620 without clogging of the screen by larger particles 640. Preferably, larger particles 640 are pushed away from the screen by the stronger force of gas/powder out of the venturi 613. Preferably, the venturi 610 amplifies the rate of fluidized powder flow from the gas/powder input 611 when input carrier gas is applied at the external gas input duct 614.

Another preferred aspect of the invention is the use of beads 650 (for example, beads of stainless steel) in conjunction with screen/mesh 620 and powders (e.g., micronized powders, 1–10 $\mu$m dia). Preferably, beads 650 are of a size to resist passing through the screen or mesh 620 and of sufficient resiliency to resist fragmenting into smaller particles. The beads are selected to attract charged particles of the powder, wherein the powder feed cell is adapted so that gas flow from the venturi output port suspends the beads sufficiently to favor association between the powder and the beads and subsequent collision of powder-coated beads with the screen 620. The size and density of the beads can be selected to discourage the beads from being sufficiently suspended to pass through the venturi 610. More preferably, the beads 650 can be used in combination with the screen/mesh 620. Preferably, beads 650 will not go through the venturi 610, for example by selecting size and density of the beads, as discussed above, or by using a second screen/mesh to prevent such access.

Figure 5A:
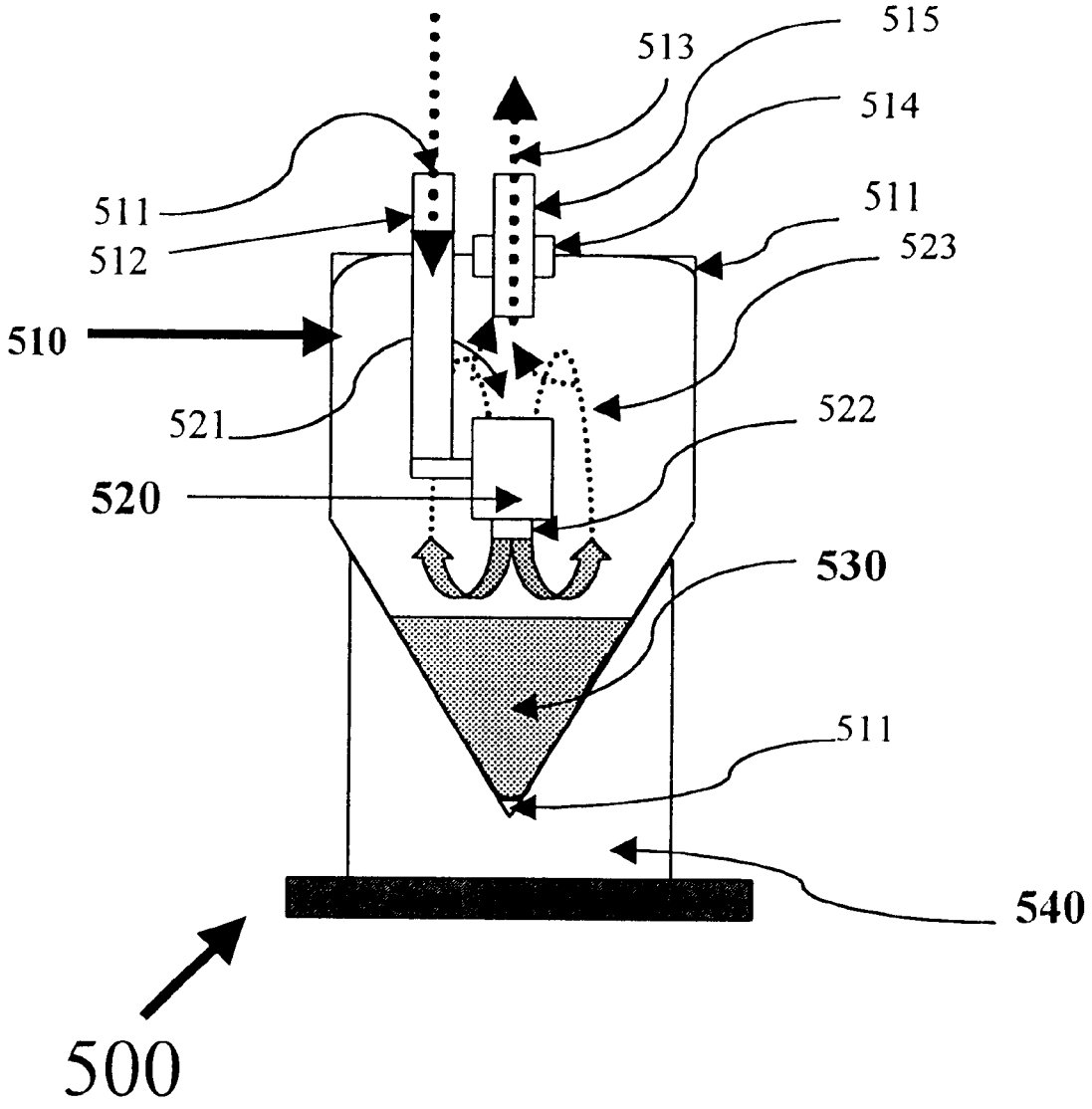
FIG. 5 illustrates a vertical configuration (FIG. 5A) and horizontal configuration (FIG. 5B) of a powder feed cell of the present invention.
Figure 5B:
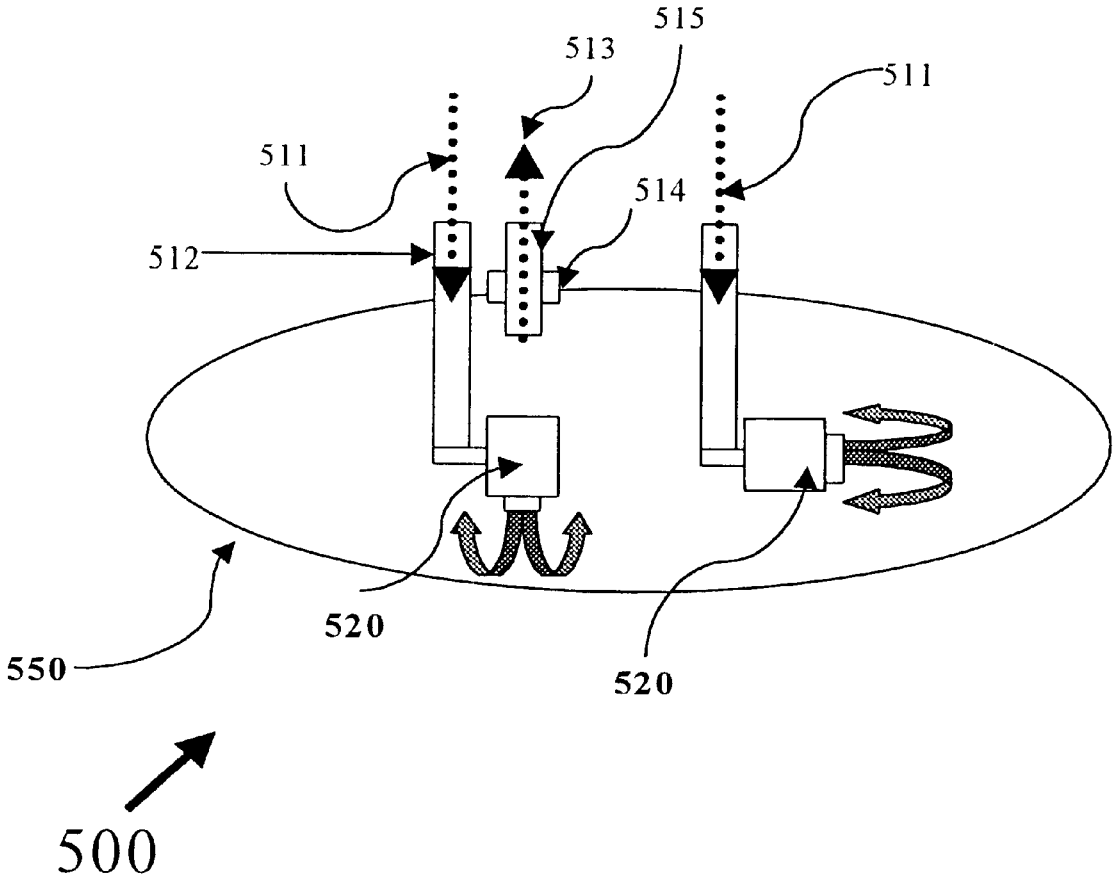
Figure 6:
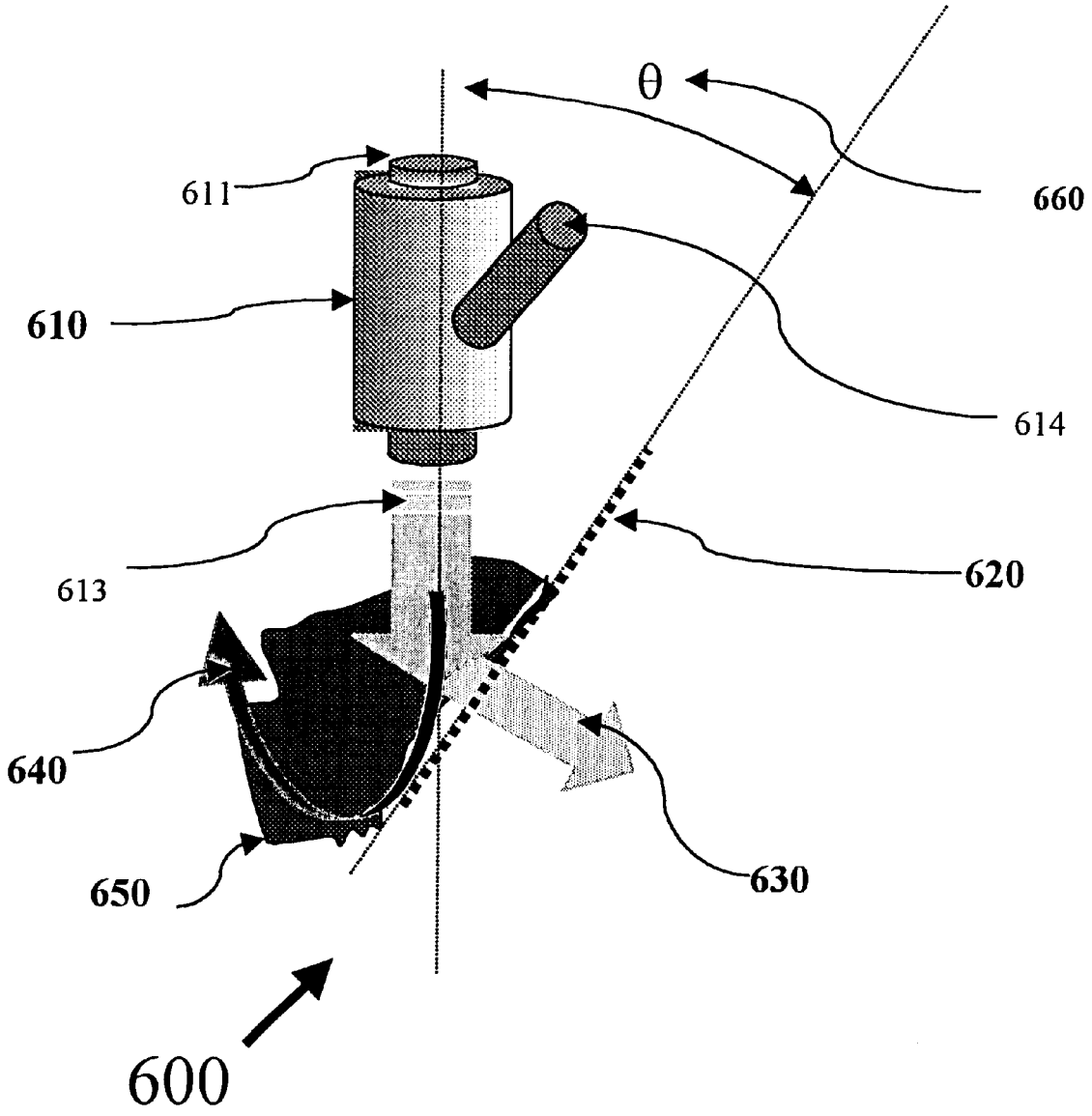
FIG. 6 shows a fluidizing powder feeder/venturi system with a mesh or a combination of a mesh and beads used to select out smaller particles from a powder.

This embodiment can be used in combination with other embodiments such as those illustrated in FIGS. 5A and 5B. For example, a powder feed cell can comprise, in the chamber, a screen/mesh 620 and beads 650. The geometry, location and orientation of the powder feed cell containing the combination of the venturi 610 and mesh 620 or venturi, mesh and beads 650 can be selected to favor the movement of larger powder particles 640 to collide with gas or gas-suspended powder particles from the venturi outlet port.

Where smaller particles 630 are disfavored, a device such as a grounded plate situated to adhere such particles can be used to remove such particles from powder selection device 600. Alternatively a small particle 630 confinement area can be periodically emptied.

A further aspect of the invention is a means for optically monitoring the amount of fluidized powder inside a system of the invention. The amount of powder flowing inside an aerodynamic based charger, such as the cyclone resonator 100 disclosed above, can be difficult to measure due to various technical problems. Recent studies of the stability of charge to mass ratio (Q/m) of powders charged by the cyclone resonator indicate that the Q/m changes with the amount of fluidized powder in the gas stream. Although the dependence factor is typically not very large (e.g. a 100% change in powder content typically results in a 10–30% change in the Q/m), to achieve Q/m stability, it is preferable that temporal fluctuations of powder content be suppressed. In order to dynamically control the powder content in the gas stream, for example, the amount of powder inside a device for the dispersal and charging of fluidized powders, such as the cyclone resonator 100, can be measured.

Figure 7A:
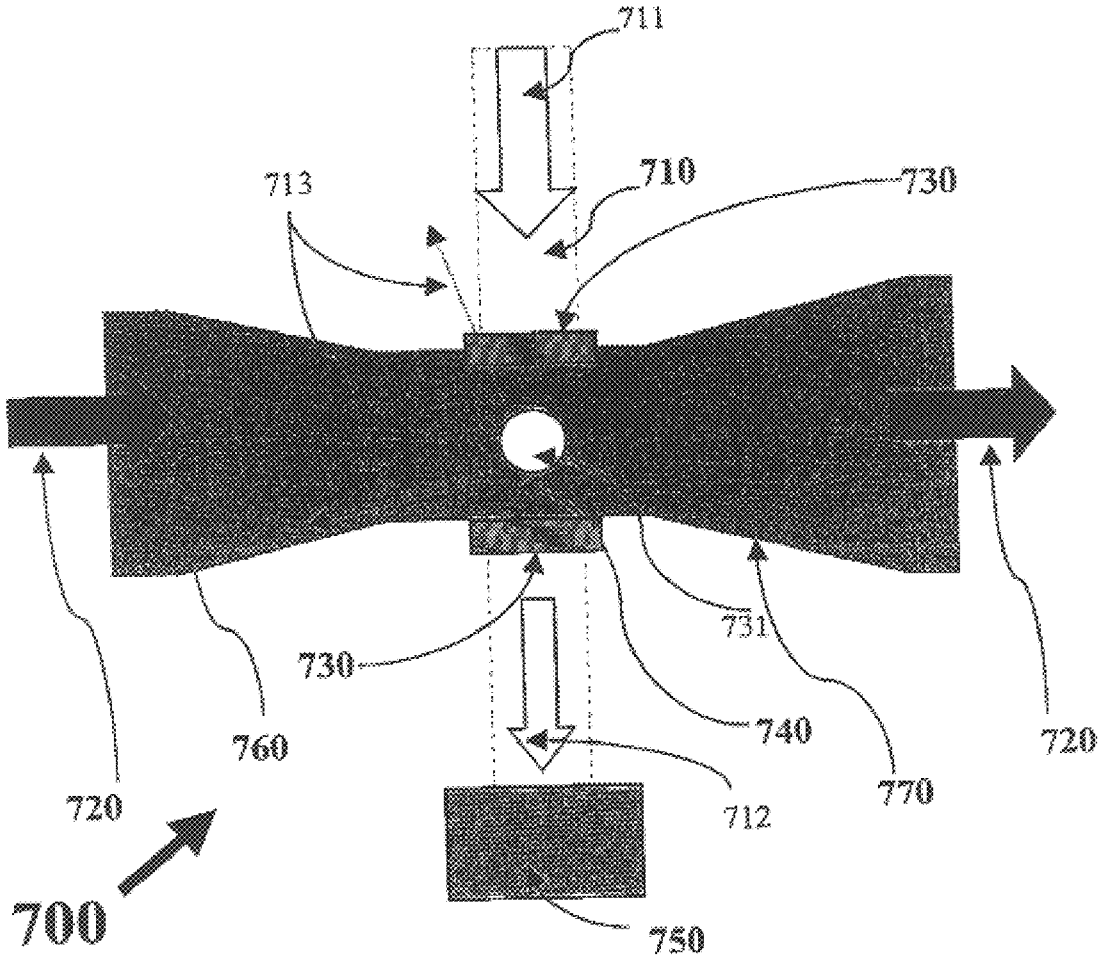
FIG. 7 shows an optical apparatus (FIG. 7A) for monitoring the amount of powder fluidized in a non-absorbing carrier gas and a schematic (FIG. 7B) thereof

An optical apparatus for monitoring the amount of powder fluidized in a carrier gas is a preferred aspect of the invention. The optical apparatus 700, as shown in FIG. 7A, comprises a laser beam 710 positioned and focused to intersect, in whole or in part, with a fluidized gas flow 720 in a conduit 770 (in cross section) through an optical interface 730, and a detector 750 positioned to monitor the transmitted 712 or scattered 713 laser light. Laser light is absorbed and scattered by fluidized particles in the volume of intersection 740 where the laser and fluidized particle stream overlap. More preferably, a fraction of the initial laser intensity, $I_o$ is absorbed by the powder particles in the volume of laser-powder intersection 740, resulting in a smaller intensity transmitted in the laser light emerging from the conduit 770, $I_T$. A small fraction of $I_o$ can be scattered in any direction by particles in the fluidized powder stream 720. Scattered light can be detected using a second detector 751 and an appropriate second optical interface 731, preferably orthogonal to both the path of the laser 710 and the fluidized powder stream 720.

Preferably, the optical interface 730 and second optical interface 731 are made of material and of a design that do not significantly interfere with the function of the device that is transporting the monitored powder. In some embodiments, the optical interface 730 can be one or more windows in communication with the wall of a fluidized powder conduit 770. The optical interface 730 or second optical interface 731 can be the wall of the conduit, or sections of the wall, so long as the wall or section is sufficiently translucent over an appropriate range of wavelengths. As the optical interface can become coated with powders in a very short period of exposure to the powder, the optical interface 730 is preferably situated so that powder coating is minimal. For example, an ultrasonic vibrator can be situated to vibrate the optical interface 730 to aid in removing powder coatings. In some embodiments of the present invention, a suitable location is sufficiently close to the exit of a venturi (the exhaust of the high gain flow amplifier), where the surface of the optical interface 730 can be cleaned by the high velocity of gas from the venturi.

The laser beam 710 can be at a wavelength, intensity, stability and mode appropriate to allow for photon absorption, scattering or both by the powder in such a way that (1) the physical and chemical properties of the powder are not substantially affected and (2) there is sufficient sensitivity, precision, accuracy and resolution in the levels of absorption or transmission of light to monitor changes in the amount of powder flowing through the volume of laser intersection with the fluidized powder flow. Preferably, a combination of laser conditions and carrier gas is selected such that the carrier gas has negligible absorption of the laser light. For example, the gas can be $O_2$ or an inert gas such as $N_2$. The laser beam may be of any kind sufficient for detection purposes, including pulsed, CW lasers and pumped laser systems.

The invention can also comprise optical devices (e.g. lenses, mirrors, irises, etc.), including but not limited to those known in the art, to position the volume of intersection of the laser and fluidized powder as desired. Preferably, the volume of laser-powder intersection 740 and the optical interface 730 can be sufficiently close to a venturi internal gas outlet to prevent, for example by the flow of high velocity gas from the venturi, powder coating on the internal surface of the optical interface 730 and to maintain a level of internal surface cleanliness on the optical interface. A device to maintain or restore a clean optical interface surface when the venturi is not pumping powder may be incorporated as well. Such a device can include, or example, an internal shutter that can close to form a barrier between a conduit and an optical interface.

A further aspect of the invention is the monitoring of scattered or transmitted light by using one or more detectors. Preferably, detectors are selected that are capable of measuring the intensity of light at the scattered or transmitted wavelengths. More preferably, the invention provides light detection with sufficient sensitivity to detect the amount of powder in the volume of intersection between the powder flow and incident laser light, for example at or near a desired resolution. Detectors for transmitted light can be placed in-line with the incident laser light, opposite the gas flow channel or conduit 770 where powder detection occurs. Detectors for scattered light may be placed at any position that is not in-line with the incident laser light. Transmission data can be corrected with concurrent scatter data, as is known in the art, and as can be further established with calibration experiments.

The optical apparatus 700 can also comprise a narrowing of the diameter of a conduit 770 transporting a powder/gas mixture such that the conduit 770 is smaller at the volume of intersection 740 between the laser 710 and the conduit 770 than at the internal gas outlet of the venturi. Preferably, the rate of powder flow through the volume of intersection 740 is increased across the optical interface 730 to further discourage deposition of powders on the optical interface surface or surfaces.

Figure 7B:
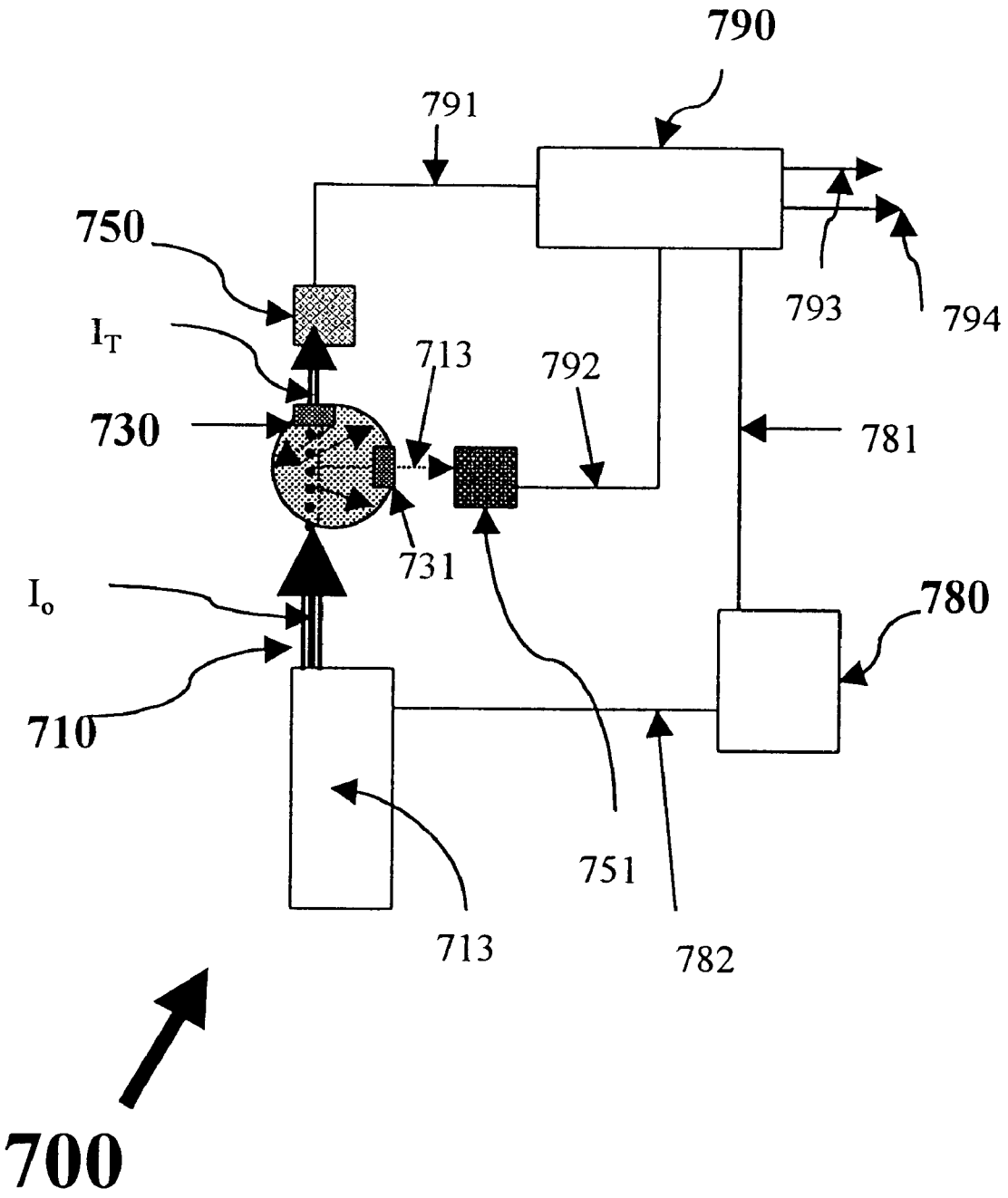

The optical apparatus 700 can further include the modulation of a stabilized laser with corresponding modulation of the detection signals, for example, to reduce optical interference and improve the signal to noise ratio of the detection process. Such modulation methods are well-known in the art, and can include use of one or more of the following: a lock-in amplifier for the detector, a detector that operates in pulsed mode, or a pulsed laser. FIG. 7B shows a schematic of an apparatus 700 of one embodiment of the invention whereby laser light 710, produced by a laser 713, can pass through a fluidized powder conduit 770. Preferably, laser light transmitted through the conduit 712 can be measured at one detector 750, while scattered light can be measured at a different detector 751. Preferably, first optical interface 730 and second optical interface 731 can be included in the conduit 770. The outputs from a detector 750 positioned to detect transmitted light and a second detector 751 adapted to detect scattered light are connected to a processor 790. Still more preferably, a modulation device 780 can also be included which can corrolate a rate of laser pulse delivery and a pulsed rate of detection at either detector. The instrumentation can provide the attenuation signal $I_o$ and the scattering signal.

Experimental data has shown that achieving uniform Q/m can depend on two parameters: (1) particle size distribution and (2) fluidized powder flux. Accordingly, it has been discovered that use of appropriate feedback loops tied to these parameters can increase the reproducibility of powder deposition manipulation by applications of the invention.

The invention further provides that a detection signal, for example from an optical apparatus 700, can be used as a feedback control to a device for charging fluidized powder, such as the cyclone resonator 100. Preferably, a detection signal from an optical apparatus 700 can be used to stabilize the powder content within a fluidized powder charging device such as the cyclone resonator 100. More preferably, a greater control of the stability of the Q/m of powders being charged or dispersed within the device can be accomplished by using a detection signal from an optical apparatus 700, to provide feedback control through a controller such as an electronic data processing device.

Figure 8A:
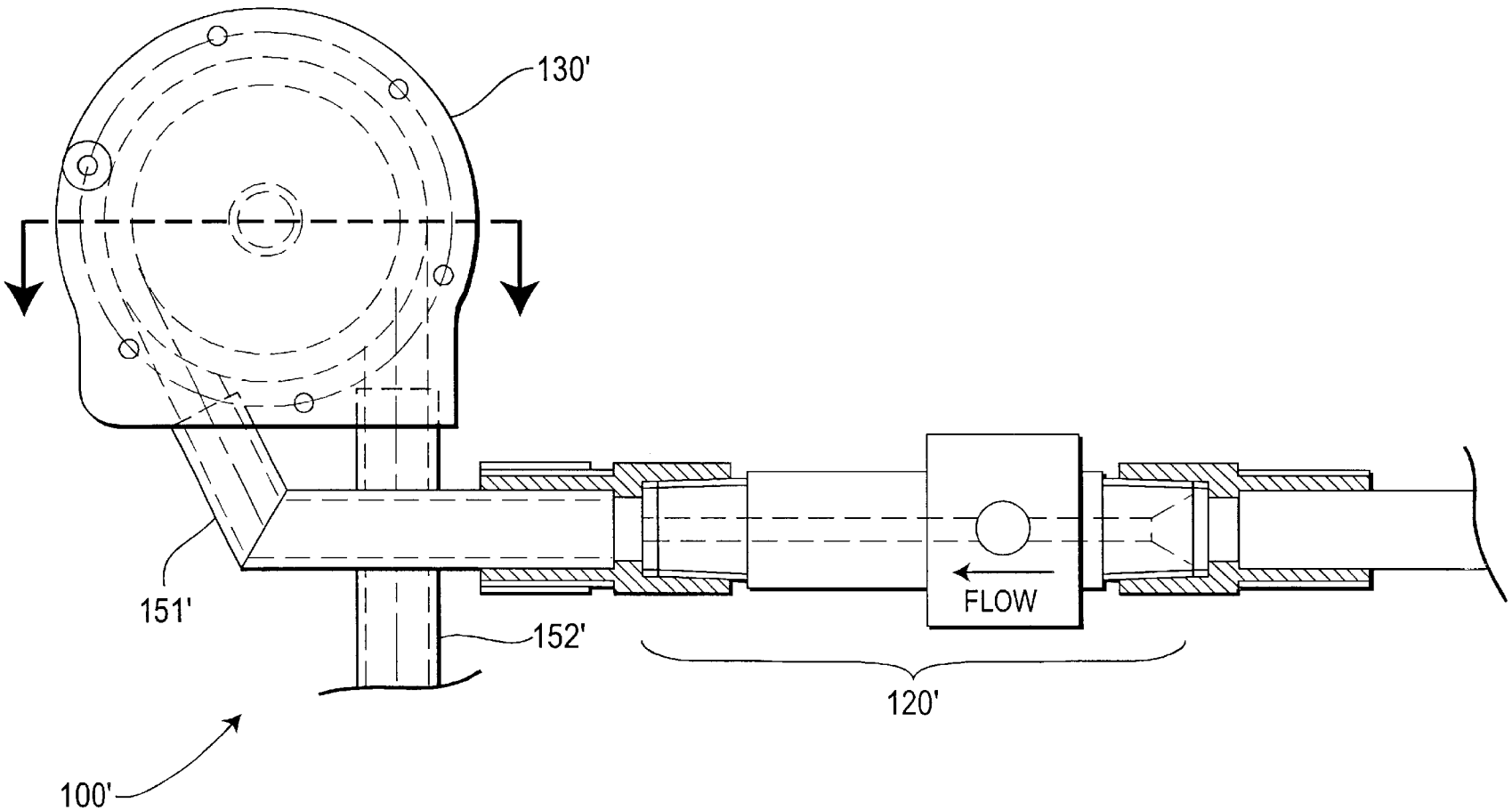
FIGS. 8A and 8B illustrate a portion of a cyclone resonator.
Figure 8B:
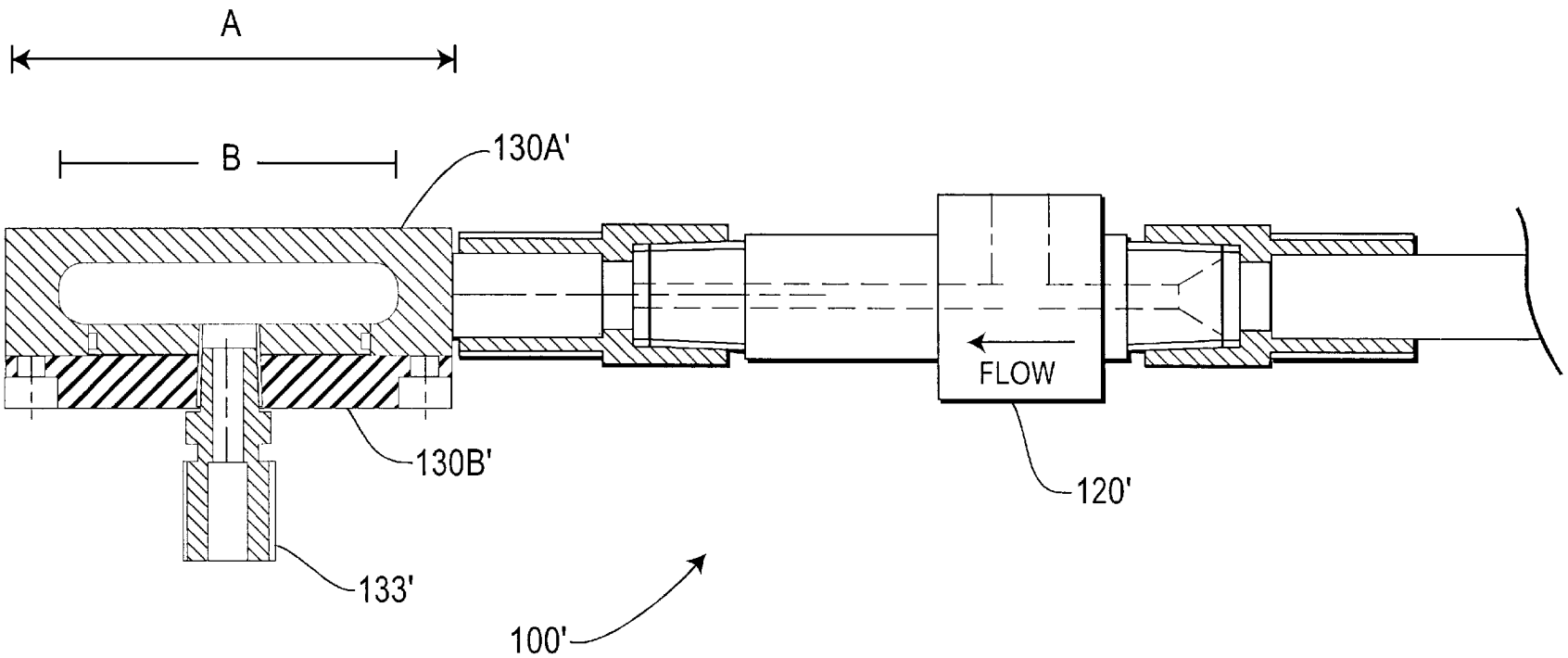

FIGS. 8A and 8B illustrate a portion of a cyclone resonator 100' with venturi 120', cyclone 130', which can be a jet mill and product port 133'. First conduit 151 and second conduit 152 can be connected to the cyclone 130' by welds. The cyclone 130' is made up of first component 130A', which is preferably formed of stainless steel, and second component 130A', which is preferably formed of dielectric such as Nylon (polyamide). Where first component 130A' or product port 133' are formed of conductive material, these components can be biased to different potentials. The cross-section of FIG. 8B is indicated in FIG. 8A. The cyclone resonator is drawn to an exemplary scale where dimension A 69 mm and dimension B 53 mm.

The feedback control provided by the use of data from inputs such as the above-described powder flux detecting device can thus be used with devices for handling or applying charged powders to increase accuracy. For example, the "Area Matched Electrostatic Sensing Chuck" of Sun et al. (SAR 13114), filed concurrently herewith, can be used in conjunction with the greater Q/m uniformity achieved with powder flux detecting device so that measurements of deposited charge are more strongly correlated with amount. Other devices or methods that can be used with various aspects of the present invention include, for example, the methods for use of transporter chucks, acoustic bead dispensers and other powder-manipulating devices set forth in Sun, "Chucks and Methods for Positioning Multiple Objects on a Substrate," U.S. Pat. No. 5,788,814, issued Aug. 4, 1998; Sun et al., "Electrostatic Chucks," U.S. Pat. No. 5,858,099, issued Jan. 12, 1999; Pletcher et al., "Apparatus for Electrostatically Depositing a Medicament Powder Upon Predefined Regions of a Substrate," U.S. Pat. No. 5,714,007, issued Feb. 3, 1998; Sun et al., "Method of making pharmaceutical using electrostatic chuck," U.S. Pat. No. 5,846,595, issued Dec. 8, 1998; Sun et al., "Acoustic Dispenser," U.S. Pat. No. 5,753,302, filed May 19, 1998; Sun, "Bead Transporter Chucks Using Repulsive Field Guidance," U.S. application Ser. No. 09/026,303, filed Feb 19, 1998; Sun, "Bead manipulating Chucks with Bead Size Selector,", U.S. application Ser. No. 09/047,631, filed Mar. 25, 1998; Sun, "Focused Acoustic Bead Charger/Dispenser for Bead Manipulating Chucks," U.S. application Ser. No. 09/083,487, filed May 22, 1998; Sun et al., "AC Waveforms Biasing For Bead Manipulating Chucks," Ser. No. 09/095,425, filed Jun. 10, 1998; Sun et al, "Apparatus for Clamping a Planar Substrate," Ser. No. 09/095,321, filed Jun. 10, 1998; Poliniak et al., "Dry Powder Deposition Apparatus," Ser. No. 09/095,246, filed Jun. 10, 1998; and "Pharmaceutical Product and Method of Making," Ser. No. 09/095,616, filed Jun. 10, 1998.

All publications and references, including but not limited to patents and patent applications cited in this specification are herein incorporated by reference in their entirety as if each individual publication or reference were specifically and individually indicated to be incorporated by reference herein as being fully set forth. Any patent application to which this application claims priority is also incorporated by reference herein in its entirety in the manner described above for publications and references.

GLOSSARY

The following definitions are provided to facilitate understanding of certain terms used frequently herein:

The term "conduit" as used herein shall encompass an enclosed connection capable of gas or powder transport without leaking between two or more points of attachment, including a direct connection between two points.

A "cyclone" or "fluid energy mill" is a device for manipulating powders, such as suspending particles, breaking apart aggregates or separating particles by generating a vortex. A great variety of cyclones are known in the art such that those of ordinary skill having benefit of this disclosure can identify numerous cyclones applicable, or which can be modified to be applicable, in the devices of the present disclosure.

The term "depression" shall include cavities in the conduit flow pathway adapted, in connection with a conductor to which a potential is applied, to a attract a substantially uniform amount of charge powder particles from the pathway; the term "depression" does not imply a downward orientation.

The term "gas input conduit" can be construed to include, depending on the context, a gas conduit operating to convey powder suspended in a gas.

A "jet mill" is a particular sub-type of cyclone that operates at higher pressure. Preferably, in certain of the devices of the present invention, the pressure or flow rate is effective to break apart particles. Thus, different types of jet mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture of the particles. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous gas jets inject pressurized air tangentially. Numerous other jet mills shall be recognized by those having benefit of this disclosure as applicable to the devices of the present disclosure.

During grinding, particles that have reached the desired size can be extracted while the remaining, coarser particles continue to be ground. Therefore, mills can also be distinguished by the method used to separate, or "classify", the particles by their size. The classifier can be mechanical and can feature a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the speed of the rotor, the smaller the particles. These particles become the mill product. Oversized particles are returned to the grinding chamber, typically by gravity. (U.S. Pat. No. 4,198,004, etc.)

The classification process can also be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to the grinding chamber. The separation of particles from a powder according to their size, also called classification, can also be accomplished by a separate classifier. For instance, U.S. Pat. No. 4,524,9154 to Yamagishi discloses an opposed type jet mill featuring a disk-shaped classifying chamber acting to separate finely pulverized powder from larger particulates based centrifugal acceleration of input particles around the circular walls of the classifying chamber from a grinding chamber. The classifying chamber is in communication with a grinding chamber, a discharge port at the center and a powder recycle port. Less centrifugal force is imparted to smaller particles entering the classifying chamber, which can escape through a discharge port at the center of the chamber, perpendicular to the center plane of the chamber. Powder grinding occurs as a result of collisions of powder supplied to the system by a flow of a carrier gas with larger particles exiting the recycle port of the classifying chamber and by collisions with surfaces inside the grinding chamber.

The term "light" shall include photons of any wavelength, especially those wavelengths that can me amplified by the stimulated emission of radiation, including but not limited to photons of the ultraviolet, visible and infared spectral regions.

The term "substantially uniform coating" as used herein encompasses a given composition of source charged powder, that is reproducibly produced to +/−8% of an experimentally determined coating amount, preferably, with reproducibility of +/−3%, or more preferably with reproducibility of +/−1%.

"Particles" are, for the purposes of this application, aggregates of molecules, typically of at least about 3 nm average diameter, such at least about 500 nm or 800 nm average diameter, and are preferably from about 100 nm to about 5 mm, for example, about 100 nm to about 500 $\mu$m. Particles are, for example, particles of a micronized powder, or polymer structure that can be referred to as "beads. " Beads can be coated, have adsorbed molecules, have entrapped molecules, or otherwise carry other substances.

The term "venturi" refers to a device well-known in the art which creates a region where the pressure of a flowing fluid decreases, typically by increasing the cross-section of the flow passageway. In many venturi, and in particular many of those relevant to the present invention, there is an aspirator inlet located in the venturi region into which fluid can be drawn by a pressure differential created by the venturi. Examples of venturi include those described in U.S. Pat. Nos. 5,934,328 and 5,678,614, and in numerous commercially available venturi.

Various modifications can be made to the device embodiments of the invention described herein without departing from the scope of the invention, as defined in the claims.

What is claimed is:

1. A powder handling device comprising:

a cyclone comprising (i) one or more surfaces at the outer circumference of the cyclone along which fluidized powder flows in a circular pattern during operation of the cyclone, (ii), intersecting one of the surfaces, an inlet, (iii), intersecting one of the surfaces, a recycle outlet, and (iv), substantially orthogonal to the circular pattern, a product outlet; and a source conduit of fluidized powder connected to the inlet comprising (i) a powder conduit connecting from the recycle outlet, and (ii), connected to the powder conduit, a venturi (a) with an aspirator inlet adapted to accept a gas feed and (b) effective to create turbulence in the fluidized powder, wherein the recycle outlet is not connected to the aspirator inlet.

2. The powder handling device of claim 1, comprising:

a external powder feed for introducing powder into the source conduit comprising the aspirator inlet to the venturi into which powder is drawn by a relative vacuum.

3. The powder handling device of claim 2, wherein the positioning of the venturi is selected so that turbulence is maintained when the fluidized powder reaches the cyclone.

4. The powder handling device of claim 3, wherein the positioning of the Venturi is selected so that an zone of high turbulence is created within 60 cm of the cyclone.

5. The powder handling device of claim 3, wherein the positioning of the Venturi is selected so that an zone of high turbulence is created within 30 cm of the cyclone.

6. The powder handling device of claim 1, wherein the product outlet is substantially orthogonal to and in the center of the circular pattern.

7. A charged powder handling device comprising:

a cyclone comprising (i) one or more surfaces along which fluidized powder flows in a circular pattern during operation of the cyclone, (ii), intersecting one of the surfaces, an inlet, (iii), intersecting one of the surfaces, a recycle outlet, and (iv), substantially orthogonal to the circular pattern, a product outlet, wherein one or more of the surfaces is adapted to contact the particles for inductive charging;

a source conduit of fluidized powder connected to the inlet comprising (i) a powder conduit connecting from the recycle outlet, and (ii), connected to the powder conduit, a venturi adapted to accept a gas feed and effective to create turbulence in the fluidized powder; and a power source adapted to provide potential effective for inductive charging to the one or more surfaces.

8. The powder handling device of claim 7, wherein the product outlet is substantially orthogonal to and in the center of the circular pattern.

9. The powder handling device of claim 7, comprising:

a powder feed for introducing powder into the source conduit comprising an aspirator inlet to the venturi into which powder is drawn by a relative vacuum.

10. The powder handling device of claim 7, wherein the positioning of the venturi is selected so that turbulence is maintained when the fluidized powder reaches the cyclone.

11. The powder handling device of claim 7, wherein the positioning of the Venturi is selected so that an zone of high turbulence is created within 60 cm of the cyclone.

12. The powder handling device of claim 7, wherein the positioning of the Venturi is selected so that an zone of high turbulence is created within 30 cm of the cyclone.

13. The powder handling device of claim 7, wherein the one or more surfaces are at the outer circumference of the cyclone along which fluidized powder flows in a circular pattern during operation of the cyclone.

14. The powder handling device of claim 7, wherein the venturi is adapted to accept a gas feed with an aspirator inlet, and wherein the recycle outlet is not connected to the aspirator inlet.

* * * * *